US005603460A

United States Patent [19]

Reid

[11] Patent Number: 5,603,460

[45] Date of Patent: Feb. 18, 1997

[54] SPLIT CONE THREAD PACKAGES

[75] Inventor: Alexander Reid, Leicester, Great Britain

[73] Assignee: Donisthorpe & Company Limited, Leicester, Great Britain

[21] Appl. No.: 374,781

[22] PCT Filed: Jul. 16, 1993

[86] PCT No.: PCT/GB93/01501

§ 371 Date: Jan. 27, 1995

§ 102(e) Date: Jan. 27, 1995

[87] PCT Pub. No.: WO94/03387

PCT Pub. Date: Feb. 17, 1994

[30] Foreign Application Priority Data

Aug. 5, 1992 [GB] United Kingdom ..... 9216617

[51] Int. Cl.[6] ..... B65H 54/00; B65H 75/10; B65H 75/28

[52] U.S. Cl. ..... 242/18 A; 242/118.3; 242/158.5; 242/607.2

[58] Field of Search ..... 242/118.3, 605, 242/607, 607.2, 609.3, 609.1, 613.1, 118.11, 158.5, 18 A

[56] References Cited

U.S. PATENT DOCUMENTS

| | | | |
|---|---|---|---|
| 1,915,200 | 6/1933 | Parks . | |
| 2,220,529 | 11/1940 | Lahr | 242/118.3 X |
| 2,235,737 | 3/1941 | Crandall . | |
| 2,524,623 | 10/1950 | Colombu . | |
| 3,334,980 | 8/1967 | Smith | 242/18 A X |
| 3,388,444 | 6/1968 | Benson | 242/118.3 X |
| 3,740,976 | 6/1973 | Fyans | 242/118.3 X |
| 3,823,885 | 7/1974 | De Schulthess | 242/18 A |
| 4,729,526 | 3/1988 | Becker et al. | 242/609.1 X |
| 4,784,341 | 11/1988 | Hill et al. | 242/18 A |
| 4,793,568 | 12/1988 | Romagnoli | 242/118.3 X |
| 5,169,087 | 12/1992 | Romagnoli | 242/118.3 X |
| 5,178,342 | 1/1993 | Romagnoli | 242/118.3 X |

FOREIGN PATENT DOCUMENTS

| | | | |
|---|---|---|---|
| 1113603 | 4/1956 | France . | |
| 2755915 | 5/1979 | Germany . | |
| 3135693 | 3/1983 | Germany . | |
| 804045 | 11/1958 | United Kingdom | 242/118.3 |
| 93/15013 | 8/1993 | WIPO | 242/605 |

*Primary Examiner*—Michael R. Mansen
*Attorney, Agent, or Firm*—Dvorak and Traub

[57] ABSTRACT

A cone on which thread is wound has a central frangible section at which it may easily be broken. The thread forms a winding on the cone at each side of the section leaving a space where it crosses the section. The cone may be snapped in half to give two independent wound cone parts, each with approximately half the amount of thread. This allows the purchaser the flexibility to use the cone in various ways. In one embodiment, the cone parts may be urged axially together after the frangible section has been broken, to become removably attached to one another with a reduced space between the respective windings.

7 Claims, 3 Drawing Sheets

SPLIT CONE THREAD PACKAGES

BACKGROUND OF THE INVENTION

1. Filed of the Invention

The invention relates to spools, cones and like devices for holding windings of thread. It is particularly applicable to packages, upon which is wound sewing thread for industrial applications.

2. Description of the Prior Art

In the clothing manufacture industry, for example, there is an increasing demand for garments to be made in small numbers at a time. Sewing thread for the making up of garments has traditionally been supplied in a number of different formats, principal among which is a cone carrying 5000 to 10000 m of thread. Where smaller quantities of thread are needed, a cop spool may be preferred, which carries typically 1000 m. The terms "thread" and "yarn" are used more or less interchangeably herein, or as idiom demands.

The large capacity of the cone can be a disadvantage as production runs become smaller and large amounts of thread are often wasted. The cop spool is a small diameter tube so that the innermost turns of yarn may be undesirably tightly coiled. Because of the small capacity of cop spools, they may need to be replaced frequently, which is time consuming because the thread from the two spools needs to be joined.

Of course, an intermediate size of spool would be possible but it is inconvenient for all concerned to deal with too many different standard sizes and, besides, it will not always be clear in advance how much thread will be required in which formats.

The term "cone" as used in this specification is not intended to limit the shape of the spool on which the thread is wound and includes, inter alia, spools of generally frustoconical and cylindrical shape.

SUMMARY OF THE INVENTION

The invention provides a cone on which thread is wound, the cone having a central frangible section at which it may easily be broken into two parts generally perpendicularly to its axis and the thread forming a winding on the cone at each side of the frangible section, leaving a space between the windings where the thread crosses the frangible section.

In a preferred embodiment, the cone includes means for attaching together the two cone parts after the frangible section has been broken, so as to reduce the space between the respective windings. This may be achieved by one cone part being partially inserted in a hollow in the other cone part, where it is removably retained by engagement between protrusions on the respective parts.

The surfaces of the cone supporting the windings on each side of the frangible section may both taper slightly in the same axial direction.

The invention also provides a method of winding thread on a cone having a central frangible section, the method comprising the steps of: (a) rotating the cone while supplying thread through a yarn guide that reciprocates relative to a datum and parallel to the axis of the cone to wind thread on the cone at one side of the frangible section; (b) advancing the yarn guide datum through a fixed distance along the axis of the cone and (c) rotating the cone while supplying thread through the reciprocating yarn guide to wind thread on the cone at the other side of the frangible section.

A preferred method includes the further step of (d) breaking the frangible section of the cone and urging the two cone parts axially towards one another to attach the parts removably together with a reduced space between the two windings.

The cone of the invention will typically be wound with a similar length of yarn to the known cone, i.e. 5000 to 10000 m. However, because the thread is in the form of two windings on either side of a frangible section, the new cone may be snapped in half to give two independent cones, each with approximately half the amount of thread. The two cones will be linked by a single thread, which can be easily cut or broken. If the cone is not broken, the thread will simply be withdrawn from one winding first and then the other, with no need for intervention at the halfway stage. Thus the invention allows the thread manufacturer to supply a single product, while allowing the purchaser the flexibility to make use of it in various ways.

It is a cause for concern that after the cone has been wound, the single thread bridging the gap between the windings on the respective cone parts might allow the yarn in the first winding to work loose during transport and handling of the cone. (The gap is necessary to allow the winding machine to operate). Also, handling of the wound cone without sufficient care could cause the frangible section to break prematurely.

Both these problems are solved by the further step of breaking the frangible section by urging the two cone parts together, to be removably attached with a reduced gap between the windings. A sufficient reduction of the gap will trap the single thread between the respective windings and prevent it from working loose. This removable attachment may be made stronger than the frangible section for increased strength during transport of the cone and does not prevent the cone from being used either as a whole or in two separate parts.

Although a snap connection between the two parts is preferred, with engagement between respective protrusions on each, other possibilities are envisaged, such as a screw thread or a bayonet connection.

It is envisaged that the cone will consist of an injection moulded plastics tube but other materials such as cardboard may be possible. The tube will be almost divided into two halves near its centre, the halves however being held together by a thin membrane around its circumference. An alternative would be for the frangible section to comprise a circumferential slot bridged by a small number of easily broken tabs.

Of course, the frangible section need not be precisely in the centre of the cone and the principle of the invention could equally be applied to cones carrying three or more separate windings, with frangible sections between each adjacent pair.

The method of winding the cones may be carried out on existing automatic thread winding machines without extensive modification. The modifications necessary are described below in relation to FIG. 4 of the drawings.

DESCRIPTION OF THE PREFERRED EMBODIMENT

Figure 1:
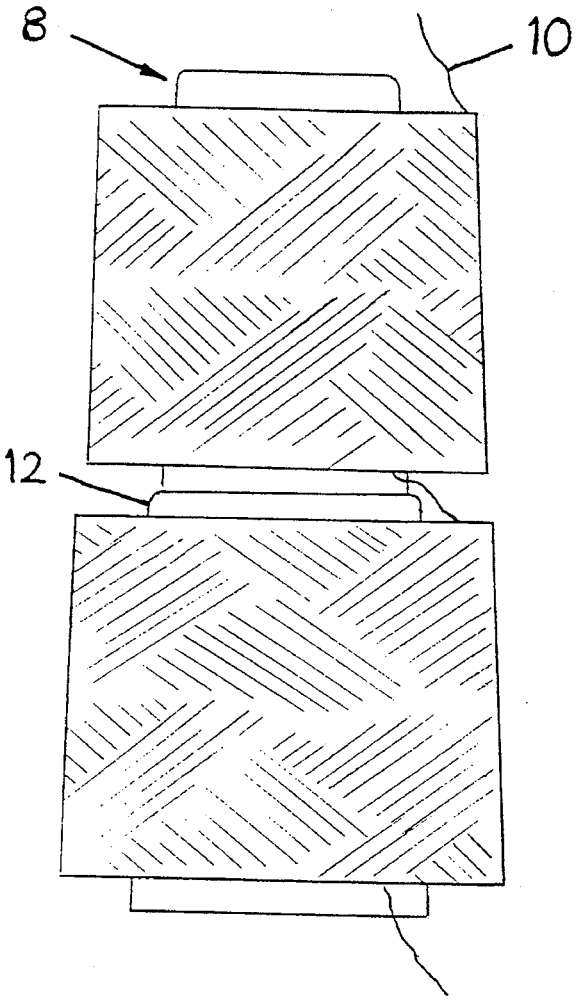
FIG. 1 is a side view of a fully wound cone according to the invention.
Figure 2:
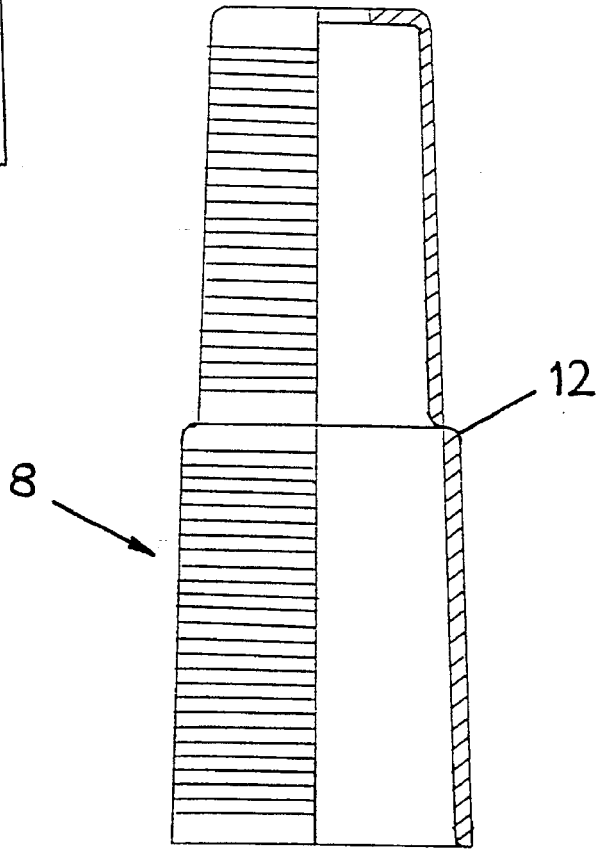
FIG. 2 is a side view, partially in section, of the cone of FIG. 1 in an unwound condition.
Figure 3:
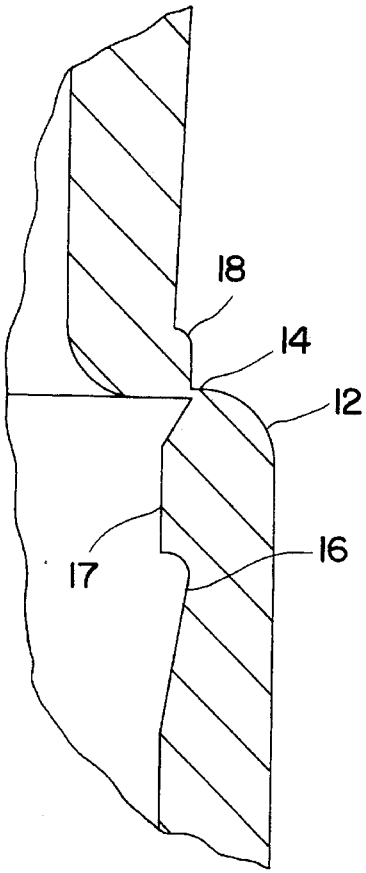
FIG. 3 is an enlargement of part of FIG. 2.

The cone 8 of FIGS. 1 to 3 is a slightly tapering hollow tube of plastics material, with a circumferential step 12 approximately halfway along its length. FIG. 1 shows how, following the winding process, a thread 10 forms a winding on the cone 8 at each side of the step 12 but not where the thread 10 crosses the step 12.

FIG. 3 illustrates the step 12 in more detail, showing how the two halves of the cone 8 are connected by only a thin membrane 14 around the circumference at that point. The membrane 14 is easily broken, allowing the two halves of the wound cone to be used separately.

If it is desired to transport the wound cone before use or to use the whole cone together, the membrane 14 may be broken by pushing the two halves of the cone axially together, rather than by pulling them apart. An outwardly facing bead 18 on the rim of the smaller diameter cone part is urged over an inwardly facing protrusion 17 on the larger diameter cone part, until the bead 18 locates within an annular recess 16 in the larger diameter cone part. Engagement between the bead 18 and the protrusion 17 holds the two halves of he cone together, so that the mutually facing surfaces of the respective windings are closer to one another than could be achieved by the winding machine. Thus the strand of thread 10 between the two windings is effectively trapped.

Figure 4:
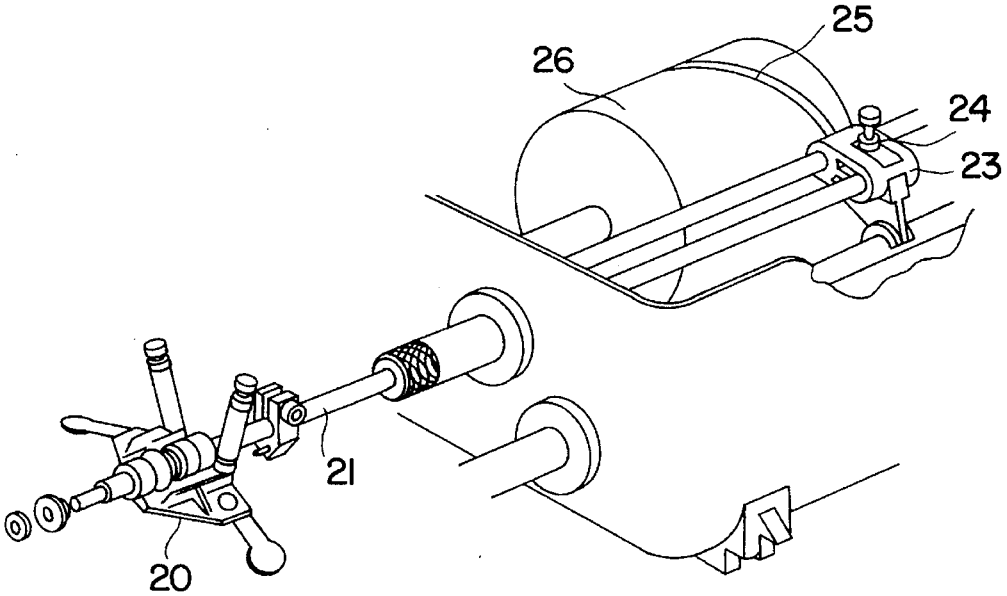
FIG. 4 PRIOR ART
FIG. 4 is a cut away perspective view of part of a known automatic thread winding machine.

The automatic thread winding machine partially shown in FIG. 4 comprises a thread guide 20 mounted on a rod 21 for depositing thread on a cone (not shown). The machine shown in FIG. 4 comprises a cam follower 23 which can be secured to the rod 21 by tightening a nut 24. The cam follower 23 has a projection engaging in a cam slot 25 on a drum 26. Rotation of the drum 26 advances and retracts the rod 21 along the cylinder as the guide 20 deposits thread thereon. In general, more than one reciprocating thread guide 20 is driven from a single cam 25.

The machine illustrated is well known; it is modified for carrying out a method according to the invention as follows. The machine is provided with a rotation counter and an electro-pneumatic valve (not shown). When the counter registers the desired number of turns wound on the first half of the cone, it causes the electro-pneumatic valve to move the drum 26 axially from a first winding position to a second winding position. The counter is then reset electrically and when it registers the desired number of turns wound on the second half of the cone, the fully wound cone is ejected in the usual way and the electro-pneumatic valve retracts the drum 26 to the first winding position ready to wind another cone.

Figure 5:
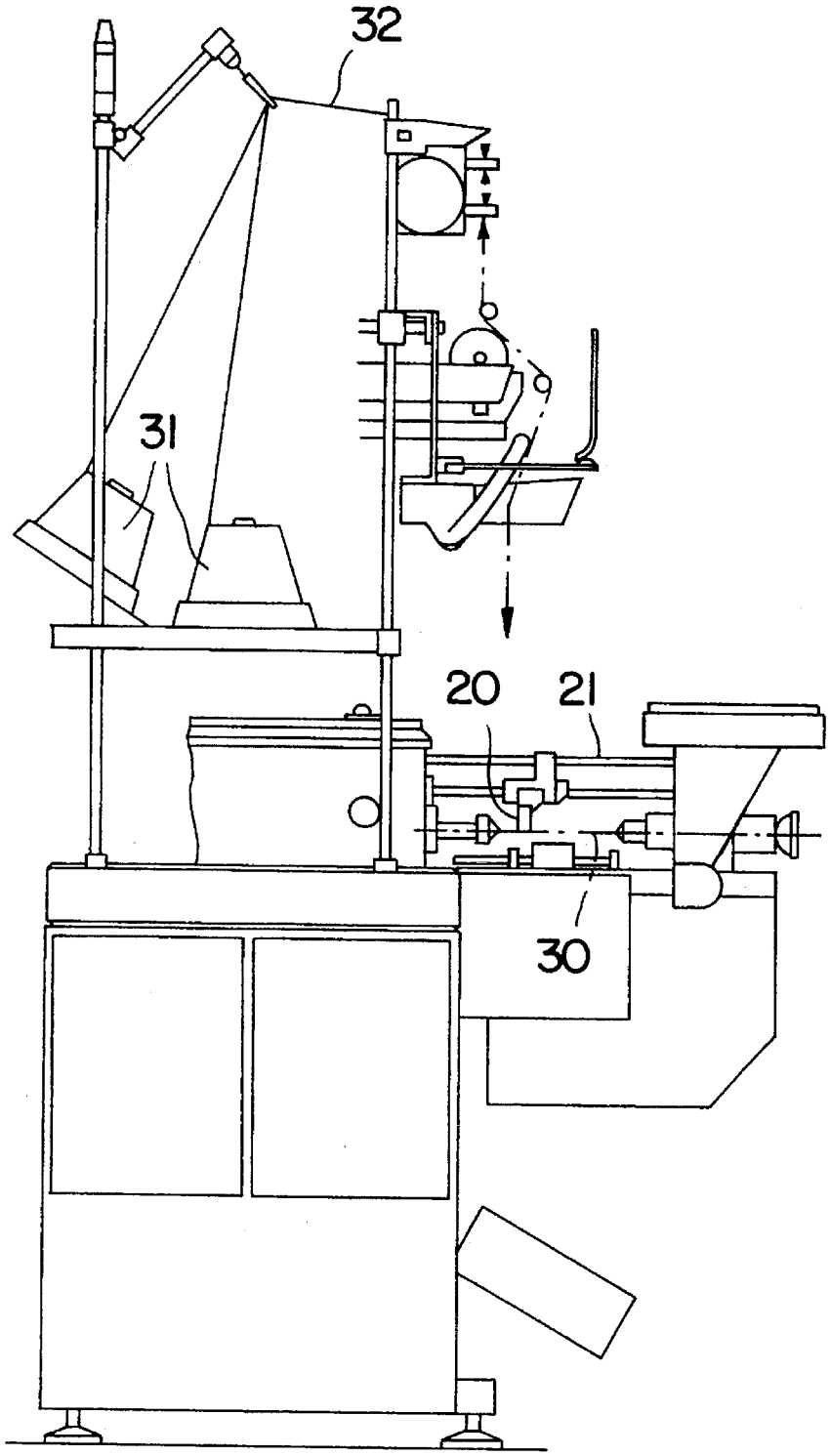
FIG. 5 PRIOR ART
FIG. 5 is a side view of the machine of FIG. 4 on a creel.

In FIG. 5, the machine of FIG. 4 is shown in outline only with the yarn guide 20 and rod 21 indicated adjacent a space 30 in which a cone according to the invention may be mounted to have thread wound thereon. Supply packages 31 are loaded on the creel, and thread ends 32 are drawn off towards the guide 20.

I claim:

1. A hollow cone on which a thread is wound, said cone having a generally cylindrical configuration disposed about a vertical axis, comprising:

an upper and head end of the cone of a first diameter, said head end having an annular rim that defines an outwardly facing bead;

a lower and tail end of the cone of a second and larger diameter than said first diameter, said tail end having an inward facing annular protrusion;

a central frangible section of the cone located between the head end and the tail end of the cone which maintains a vertical spacing between said ends, said frangible section comprised of a thin membrane integrally connecting said head and tail ends, said membrane being easily broken such that said cone ends can be pushed axially together, wherein said outwardly facing bead is urged over said inwardly facing protrusion and into releasable engagement, thereby forming a shortened cone with a reduced space between said cone ends.

2. The cone according to claim 1 wherein said first diameter of the head end of the cone and the second diameter of the tail end of the cone taper inwardly along a same axial direction along said vertical axis, said taper being constant from said lower end to said upper end.

3. The cone according to claim 1 wherein said membrane is of an annular and continuous form.

4. The cone according to claim 1, wherein said inward facing protrusion includes an annular recess for seating said outwardly facing bead therein.

5. A method of winding a continuous and single length of thread on a hollow cone having an upper head end, a lower tail end, and a central frangible section therebetween, said frangible section maintaining a spaced relationship between said ends and formed from a thin membrane that is easily breakable, said membrane integrally connecting said ends together, said cone disposed about an axis, comprising the steps of:

rotating the cone about its axis;

supplying the thread through a yarn guide that reciprocates relative to a datum and parallel to the axis of the cone to form a first winding of the thread at one of the head end and tail end of the cone;

advancing the yarn guide datum through a fixed distance along the axis of the cone, such that said thread is strung frangible section and onto the other of said head and tail ends of said cone;

rotating the cone while supplying the thread through said same yarn guide to form a second winding of the same thread on the other of the head and tail ends of the cone;

breaking the central frangible section of the cone;

urging the head end of the cone axially toward the tail end of the cone; and removably attaching the head end of the cone within the tail end of the cone so as to form a reduced space between the windings wherein said thread that is strung between each of said ends is protected within said reduced space.

6. The method according to claim 5 wherein the rotation of the cone proceeds until a predetermined number of rotations of the thread are wound onto the head end of the cone and wherein the rotation of the cone further proceeds until a predetermined number of rotations of the thread are wound onto the tail end of the cone.

7. The method according to claim 5 wherein the reciprocating of said yarn guide results from the yarn guide guard engaging a rotating cam and wherein the advancing of the yarn guide guard results from advancing the cam parallel to said axis of rotation of said cone.

* * * * *